United States Patent [19]

Bachmann

[11] 3,969,894

[45] July 20, 1976

[54] INTERNAL COMBUSTION ENGINE

[76] Inventor: William V. Bachmann, 22517 Ten Mile Road, St. Clair Shores, Mich. 48080

[22] Filed: Sept. 3, 1974

[21] Appl. No.: 502,640

Related U.S. Application Data

[63] Continuation of Ser. No. 452,259, March 18, 1974, abandoned, which is a continuation-in-part of Ser. No. 365,161, May 30, 1973, Pat. No. 3,805,524, which is a continuation of Ser. No. 116,892, Feb. 19, 1971, abandoned.

[52] U.S. Cl. ..... 60/307; 123/51 BC; 123/52 B; 123/73 CC; 123/193 CP

[51] Int. Cl.[2] ..... F02B 75/10; F02B 75/18

[58] Field of Search .... 60/307; 123/73 CC, 193 CP, 123/52 B, 51 BC, 193 R

[56] References Cited

UNITED STATES PATENTS

| | | | |
|---|---|---|---|
| 1,153,432 | 9/1915 | Iler | 123/52 B |
| 1,176,207 | 3/1916 | Dempsey | 123/73 CC |
| 1,514,475 | 11/1924 | Still | 123/52 B |
| 2,079,289 | 5/1937 | Janicke | 123/52 B |
| 2,229,240 | 1/1941 | Everts | 123/193 R |
| 2,281,821 | 5/1942 | Balmer | 123/51 BA |
| 2,734,494 | 2/1956 | Waterval | 123/52 B |
| 3,192,706 | 7/1965 | Dolza | 60/307 |

*Primary Examiner*—Douglas Hart
*Attorney, Agent, or Firm*—Lon H. Romanski

[57] ABSTRACT

An internal combustion engine includes an annular or ring-type cylinder and piston therein; exhaust ports from the cylinder lead to an afterburner reactor situated generally medially of the annular cylinder; the exhaust gases are further burned within the afterburner section; to further reduce pollulants during the afterburning process, additional air is pumped into the afterburner section by the ring piston due to its special configuration enabling it to accomplish, for example, triple functions such as: (*a*) to act as a power transmitting means, (*b*) to act as a pumping means to supply the engine's combustion chamber with scavenging air and/or an air-fuel mixture, and (*c*) to act as an air pumping means to supply desired quantities of ambient air into the afterburner section even in timed intervals with a constant predetermined pressure and predetermined quantities in order to thereby maximize the degree of control of the temperature generated in the afterburner and thereby more nearly fully oxidize the unburned fuel residues entering the afterburner. The ring piston is so constructed that it can be operatively connected to an output shaft as through the use of only a single crank, single connecting rod and wrist pin.

36 Claims, 15 Drawing Figures

INTERNAL COMBUSTION ENGINE

RELATED APPLICATIONS

This application is a Continuation of my copending application Ser. No. 452,259 filed Mar. 18, 1974, entitled INTERNAL COMBUSTION ENGINE, now abandoned, which, in turn, is a Continuation-in-Part of my earlier filed application Ser. No. 365,161 filed May 30, 1973, entitled INTERNAL COMBUSTION ENGINE now Pat. No. 3,805,524 which, in turn, is a Continuation of my earlier filed application Ser. No. 116,892 filed Feb. 19, 1971, now abandoned.

BACKGROUND OF THE INVENTION

The recent public awareness of and concern regarding air pollution has resulted in a considerable attack on the automotive engines of the prior art and the part that they play in contributing to the problem of air pollution. However, dealing with the acute air pollution problems, stemming from the great number of automobiles in operation is, to say the least, very complicated in theory as well as in practice. In fact, the latest experiences in the art of pollution-controlling technology, in connection with Otto cycle reciprocating piston internal combustion engines, has conclusively shown that the costly add-on pollution control devices greatly increase the fuel consumption of such an engine when compared to the same engine previously operating without such devices. If the prior art proposed solutions are analyzed, it will be found that each proposed solution or system has more flaws than efficiency. Even combining the most desirable features of every system heretofore proposed would not achieve much more than raise the overall cost of the engine.

The basic obstacle to an efficient remedy for the air pollution produced by the automotive engines must be attributed to the peculiarities of the design principles on which such prior art engines have been engineered to obtain the present day high performance.

In the past, high performance but inexpensive engines was the general goal. However, in achieving such a goal, the inherent pollution potential of such engines was totally disregarded. Now, because of the concern with air pollution, the problem of eliminating the pollution created by such prior art engines has been added to the overall design considerations for such engines. However, it has been found that such prior art engines do not readily adapt themselves to the additional tasks (the limitation or elimination of exhaust pollutents) which they are now expected to perform. Therefore, only minor improvements have been and will be made in the future with, what is considered, unreasonable cost penalties.

A successful solution to the problem of exhaust emissions and air pollution can hardly be expected with the use of technology as is known in the prior art. For example, the following are but a few of the characteristics of the prior art internal combustion reciprocating engines which present a hinderance to arriving at a successful solution of air polluting exhaust emissions.

Today's high performance internal combustion engines are generally of the eight-cylinder, four-stroke type and have:

1. a high compression ratio, some in the order of 10:1 or over;
2. dual or four barrel carburetors;
3. a 300 to 400 cubic inch breathing volume;

4. a crank speed, at rated horsepower, of from 4,000 to 5,000 R.P.M.;
5. intake and exhaust valves (some single - some dual) which can leak;
6. mechanism intended for synchronizing the opening and closing of the intake and exhaust valves resulting in such valves having inherently built in blow down losses which waste fuel and contribute to the pollution of the air;
7. exhaust manifolds which are always filled to capacity with piston exhaust residues which are incompletely burned gases and as such rush through the manifold at sonic speeds;
8. carburetor fuel-air mixtures leaking (or evaporating) to the ambient atmosphere;
9. unburned fuel-air mixtures leaking into the interior of the engine crankcase;
10. inherent crankcase pollution with resulting varnish deposits and sludge contamination of the crankcase oil;
11. erosion of vital engine parts and exhaust muffler system by attack of lead acids arising from the combustion of leaded fuels;
12. the need for at least limited amounts of tetraethyl lead to lubricate valve seats to prevent mechanical erosion thereof;
13. heat losses through cylinder walls, cylinder heads and pistons but mostly through early exhausting of the combustion gases to the atmosphere;
14. exhaust emissions comprised of quantities of hydrocarbons, monoxide, lead, nitrous oxide and sulphur acids far too great to be tolerable;
15. a fuel to power conversion efficiency of less than 27%; and
16. a mechanical efficiency of not more than 85%.

Nearly every engine characteristic listed in the foregoing may be declared as being adverse to any corrective measure which is intended to reduce air polluting exhaust emissions of such prior engines. The efforts to solve the exhaust emission pollution problem within the limitations found and described above for any of the conventional internal combustion engines have resulted, as is generally well known, in very disappointing side effects. All prior art proposed technical solutions, even if they operated at all, have unsatisfactory side effects. For example, in addition to the fact that such prior art devices are generally of an exorbitant cost, more space is required in and about the vehicle engine compartment to accommodate such prior art devices, the vehicle has to carry the extra weight of such prior art devices, and on an average the fuel consumption of the engines increased by approximately 20%.

The resulting increase in rate of fuel consumption is, of course, of national concern and therefore, it is submitted that an acceptable solution to engine exhaust emissions requires that the engine reduce its emission output without any increase in the rate of fuel consumption. This, the prior art has not been able to achieve.

Accordingly, the invention as herein disclosed and described is concerned with the elimination of such of the above characteristics as are deemed to be incompatible to an engine which is highly efficient and yet capable or producing its power without the attendant exhaust pollutents of the prior art.

SUMMARY OF THE INVENTION

According to the invention an internal combustion engine comprises an engine housing with an annular cylinder formed therein which receives a ring piston for reciprocating movement therein, an afterburner section formed generally medially of the annular cylinder and effective to receive the exhaust gases from the annular cylinder for further burning with added ambient air with such air being supplied even in measured quantities.

A general object of the invention is to provide an improved internal combustion engine which inherently provides a dramatically reduced level of exhaust emissions thereby reducing its contribution to air pollution.

Another object of the invention is to provide an improved internal combustion engine which inherently provides for simpler, less frequent and less costly maintenance and servicing.

Another object of the invention is to provide an improved internal combustion engine wherein crankcase blow-by emissions can be if not totally eliminated, at least substantially reduced.

A further object of the invention is to provide an improved internal combustion engine which can be efficiently operated with unleaded fuels.

A still further object of the invention is to provide an improved internal combustion engine which does not require the use of time movable inlet and exhaust valves although the use thereof is not precluded.

Another object of the invention is to provide an improved internal combustion engine wherein the piston speed can be drastically reduced without effecting the power output thereof.

Another object of the invention is to provide an improved internal combustion engine which substantially reduces the heat loss through the cylinder walls and cylinder head and be further effective to convert such heat saved thereby to be part of the work-output of the engine.

A further object of the invention is to provide an improved internal combustion engine where ambient air is drawn in by the action of the engine's reciprocating piston to act as a coolant for the inner cylinder wall and as a mixing agent to the exhaust gases via the afterburner thereby promoting the oxidation of the unburned particles within the exhaust emissions.

Other general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
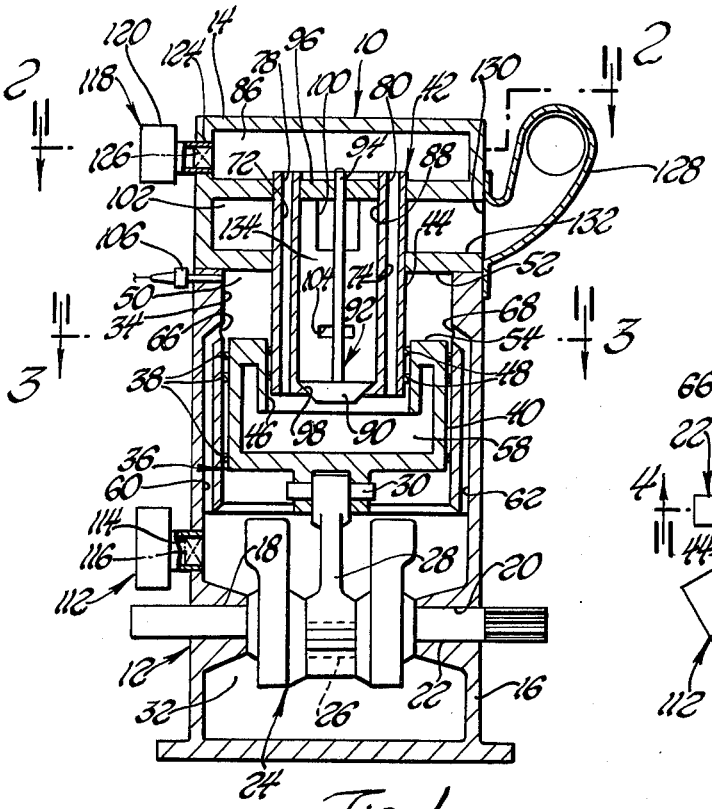
FIG. 1 is a general medial elevational cross-sectional view, of an engine constructed in accordance with the teachings of the invention, taken generally on the plane of line 1—1 of FIG. 2 and looking in the direction of the arrows.
Figure 3:
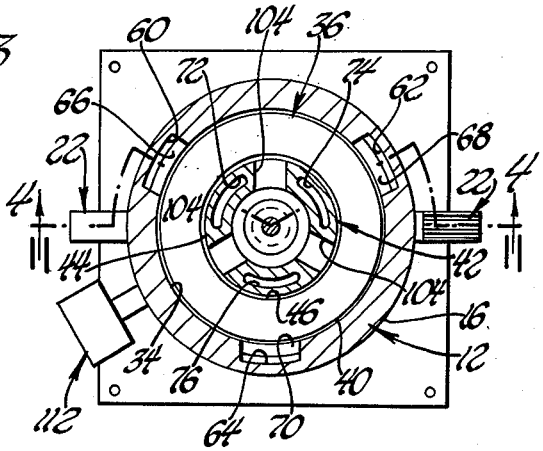
FIG. 3 is a transverse cross-sectional view taken generally on the plane of line 3—3 of FIG. 1 and looking in the direction of the arrows.

Referring now in greater detail to the drawings, FIGS. 1–6 illustrate, in somewhat simplified form, an engine 10 constructed in accordance with the teachings of the invention. As illustrated, the engine 10 comprises an engine housing 12 with upper 14 and lower 16 engine housing sections suitably fixedly secured to each other as by any suitable means. The lower portion of lower housing section 16 is provided with suitable support bearings or journals 18 and 20 which rotatably support a power output shaft 22 including crank means 24 which has an eccentric or throw 26 rotatable therewith and suitably journalled to one end of a connecting rod 28 which, in turn, has its upper and suitably secured or journalled to a wrist pin 30. The space within lower housing section 16 generally accommodating the crank means 24 may be referred to as the crank chamber or cavity 32.

The upper portion of lower housing section 16 has a cylindrical wall 34, formed internally thereof, which receives a cup-like ring piston 36 for reciprocating movement therein. As is generally well known in the art, suitable piston rings 38 may be provided and carried by piston 36 as to affect a seal as between the cylindrical wall or chamber 34 and the juxtaposed outer surface 40 of piston 36.

A generally cylindrical member 42, which may be suitably fixedly secured to upper housing section 14, has a downwardly depending portion with an outer cylindrical surface 44 formed thereon and adapted to be generally received in the piston 36. As illustrated, the piston 36 is also provided with an inner cylindrical wall or surface 46 generally juxtaposed to surface 44. A plurality of inner piston rings 48 may also be provided and carried by piston 36 as to affect a seal as between the outer cylindrical wall or surface 44 and the juxtaposed inner surface 46 of piston 36.

The variable but distinct volume or space 50, defined radially as between cylindrical surfaces 34 and 44 and axially as between the lower surface 52 of upper housing section 14 and the top or upper surface 54 of ring piston 36, may be referred to as the combustion chamber.

Piston 36 may be provided with a lower downwardly depending portion 56 by which it is operatively journalled to the upper end of connecting rod 28 through the wrist pin 30.

As shown, an additional chamber 58, of generally variable volume, is defined internally of the cup-shaped ring piston 36 by cooperation with the downwardly depending portion of member 42.

The lower housing section 16 has a plurality of passages or conduit means 60, 62 and 64 which have lower openings communicating with the crank chamber 32 and upper openings 66, 68 and 70 communicating with the combustion chamber 50.

Housing member 42 is also provided with a plurality of passages 72, 74 and 76 which have their respective upper ends or openings 78, 80 and 84 in communication with upper chambers 86 formed within upper engine housing section 14, and their respective lower ends or openings in communication with variable chamber 58. Member 42 is also formed with an inner clearance passageway 88 to permit the free movement therein of a valve head 90 of a valving member 92 comprising a stem 94 which may be guiding and slidably received within a closure member 96 situated as at the upper portion of member 42. The lower portion of member 42 is provided with a generally annular valve seating surface 98 adapted to be at times in sealing engagement with valve member or head 90 as to thereby prevent communication therethrough and between passageway 88 and chamber 58.

A first plurality of radially directed ports 100 are formed through member 42 as to thereby maintain communication as between passageway or conduit means 88 and a second chamber 102 formed within upper housing section 14 while a second plurality or radially directed ports 104 are also formed through member 42 in order to provide for communication as between conduit or chamber means 88 and combustion chamber 50.

Figure 4:
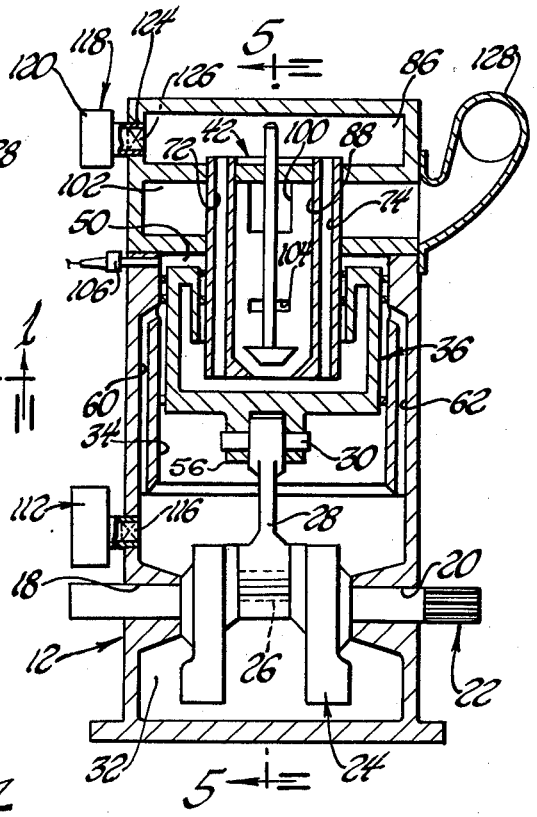
FIG. 4, a view taken generally on the plane of line 4—4 of FIG. 3 is similar to FIG. 1 but illustrating the engine in a different condition of operation from that shown in FIG. 1.
Figure 5:
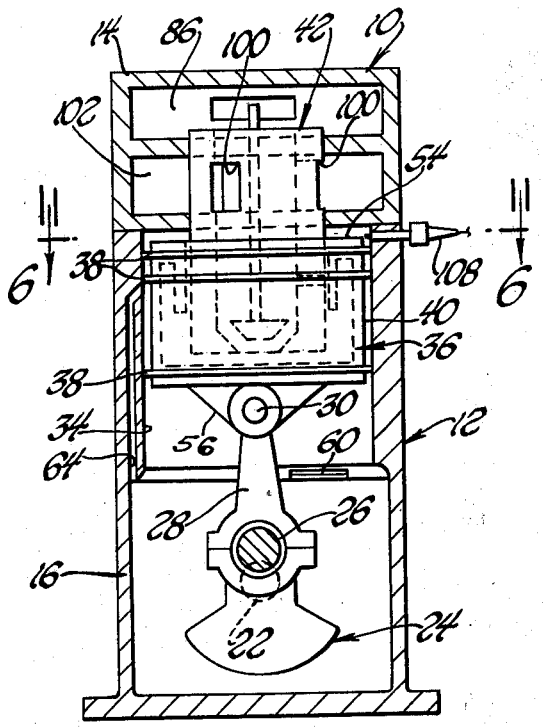
FIG. 5 is a view taken generally on the plane of line 5—5 of FIG. 4 and looking in the direction of the arrows.
Figure 6:
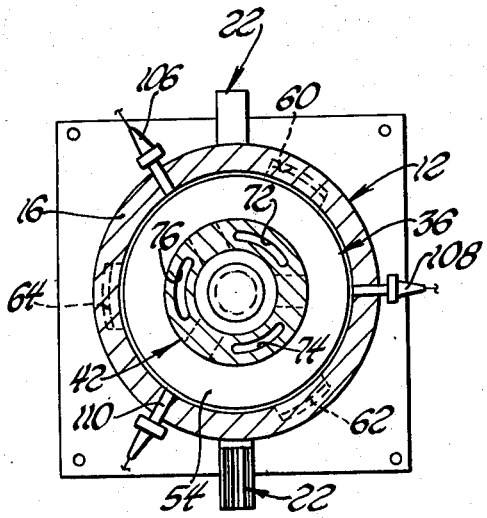
FIG. 6 is a view taken generally on the plane of line 6—6 of FIG. 5 and looking in the direction of the arrows.

Preferably, as best shown by FIGS. 1, 4 and 6 a plurality of angularly substantially equidistantly spaced plugs or nozzles 106, 108 and 110 are provided. (Element 106 is shown rotated out of position in FIGS. 1 and 4 in order to better typically illustrate the vertical location thereof.) The reason that elements 106, 108 and 110 are referred to as "plugs" or "nozzles" is that they may be ignition spark plugs or igniters in an engine where such are required to initiate combustion of the combustible mixture within the combustion chamber or they may be fuel injection nozzles if the engine is intended to operate, for example, on diesel fuel. If such elements are in fact spark plugs their operation is, of course, timed with respect to the movement of the piston 36 as by any suitable means (not shown) many of which are very well known in the art. Further, if such elements 106, 108 and 110 are in fact fuel injection nozzles, they would also be in combination with any suitable associated fuel supply and metering control means, not shown but many of which are also very well known in the art.

In one embodiment of the invention the fuel is supplied as by a suitable throttle-controlled carburetor assembly 112 communicating via conduit means 114 with the crank chamber 32. Suitable check valve means 116 may be provided in conduit means 114 in order to permit flow of motive fluid from the carburetor 112 to the crank chamber 32 but prevent flow from the crank chamber to the carburetor. An ambient air intake assembly 118 comprised of a housing 120, containing a suitable filter material 122, communicated with chamber 86 as by conduit means 124 which also preferably contains suitable check valve means 126 which permits flow into chamber 86 but prevents flow from chamber 86 to the housing 120 and ambient atmosphere.

Figure 2:
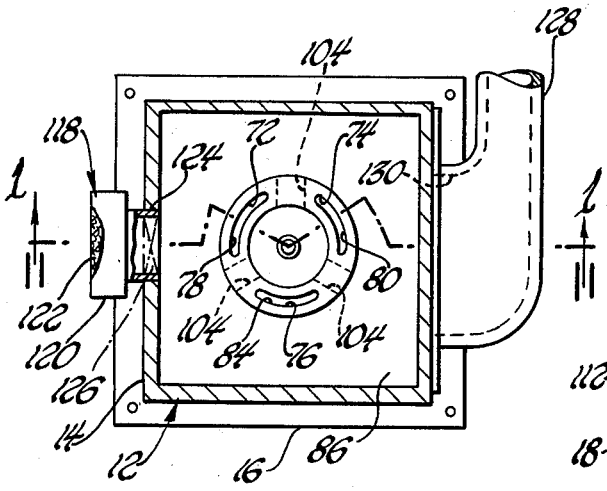
FIG. 2 is a generally top plan view of the engine with portions thereof in cross-section and other portions shown in elevation with such view being taken generally on the plane of line 2—2 of FIG. 1 and looking in the direction of the arrows.

As shown in FIGS. 1, 2 and 4, suitable exhaust conduit means 128 is provided and suitable fixedly secured, as by any suitable securing means (not shown), to the engine housing as to have its inlet 130 in registry with the outlet orifice 132 of chamber 102. The purpose of conduit means 128 is, of course, to convey the engine exhaust gases to any desired point away from the engine.

OPERATION OF INVENTION

For ease of discussion, let it be assumed that the engine 10 is operating and that the piston 36 has reached its bottom dead-center position, as depicted in FIG. 1, and is now just starting its upward movement toward its top dead-center position as generally depicted in FIG. 4. Further, let it be assumed that combustion chamber 50 is fully charged with a combustible fluid mixture and that ring piston chamber 58 is fully charged with air. At this time valving member 92 will be closed as to have valve portion 90 seated against seating surface 98.

As piston 36 starts to move upward, ports 66, 68 and 70 are closed by piston 36 and communication as between crank chamber 32 and combustion chamber 50, through conduit means 60, 62 and 64 is terminated. Continued upward movement of piston 36 will tend to create a sub-atmospheric pressure within crank chamber 32 which, in turn, causes the carbureting device 112 to supply a fuel-air mixture to crank chamber 32 via conduit means 114. The combustible mixture within combustion chamber 50 is continually compressed by the continued upward movement of piston 36 until ignition of such combustible mixture is initiated as by the associated igniters which may occur, depending upon the overall engine ignition timing, generally at this time that piston 36 reaches its top dead-center position. Once such ignition occurs, the expansion of combustible charge within chamber 50 drives piston 36 downwardly toward its bottom dead-center position. However, while piston 36 was traveling upwardly, the volume of the ambient air within chamber 58 will tend to undergo compression. That is, for sake of illustration, let it be assumed that valve portion 90 is forceably held closed regardless of the pressure differential thereacross. With such an assumption it can be seen that, functionally, chambers 86 and 58 and passages 72, 74 and 76 may be considered as a single chamber and that because of check valve 126 prohibiting flow from chamber 86 to the ambient atmosphere, the air contained in the functionally single chamber would undergo compression as piston 36 moves upwardly reducing the effective volume of chamber 58. However, the valve portion 90 is not in fact held shut against all pressure differentials thereacross, even though it is contemplated that resilient or spring means may be provided, if desired, as to at least tend to urge valve portion 90 toward its seated position. Further, it should be noted that when valve portion 90 is seated that a chamber 134 is defined generally as within wall surface 88 and between valve portion or head 90 and closure 96. Because of the communication provided by exhaust conduit means 128, outlet 132 of chamber 102, chamber 102 and orifices or ports 100, chamber 134 may be considered as being at substantially ambient atmospheric pressure. Therefore, as piston 36 starts to move upwardly thereby reducing the effective volume of chamber 58, any accompanying increase in pressure within chamber 58 is applied to one side of valve portion 90 while the chamber 134 side of valve portion remains at a relatively lower pressure. (If not already apparent, it should be noted that upward movement of piston 36 not only closes ports 66, 68 and 70, but also closes the plurality of exhaust ports 104.)

Valve portion 90 will remain closed until the pressure differential thereby created by upward movement of piston 36 overcomes the weight of valving means 92. (Where a resilient biasing means is employed in combination with valving means 92, the pressure differential would have to be sufficient to overcome both the weight of the valving means 92 as well as the resilient force of such biasing means.) As will be seen, prior to valve portion 90 being opened, ports 104 had conveyed the exhaust gases from combustion chamber 50 radially inwardly into chamber 134 which serves as an afterburner chamber. To this end, member 42 may be considered an afterburner section of the overall engine 10. Therefore, as valve portion 90 is opened, fresh and clean air is pumped into afterburner chamber 134 so as to mix with the exhaust gases flowing therethrough and thereby support further combustion of any portion of the exhaust gases which were still unburned in the combustion chamber 50 prior to their flow into the afterburner chamber. After the piston 36 reaches its top dead-center position, the pressure differential previously created across valve portion 90 ceases and the opened valve 90, shown in FIG. 4, again closes, as is shown in FIG. 1, thereby terminating communication as between afterburner chamber 134 and variable pumping chamber 58.

As piston 36 starts to move downwardly toward its bottom dead-center position, the fuel-air mixture previously introduced into the crank chamber 32 (which also, as shown, includes the space under piston 36) starts to become somewhat compressed because: (*a*) downward movement of piston 36 causes a decrease in the effective volume of crank chamber 32; (*b*) initial downward movement of piston 36 does not immediately open ports 66, 68 and 70 of passages 60, 62 and 64; and (*c*) check valve means 116 in conduit means 114 prevents flow out of the crank or charging chamber 32 and into carburetor means 112.

Also such downward movement of piston 36, by virtue of pumping chamber 58 now increasing in effective volume, causes fresh ambient air to be drawn into expanding chamber 58 through conduit means 72, 74 and 76 from upper plenum or chamber 86 with such air as may have existing in chamber 86 being replenished through the air intake 118. Such flow of air continues until piston 36 reaches its bottom dead-center position.

After the piston 36 moves a sufficient distance downwardly from its top dead-center position, supply or inlet ports 66, 68 and 70 as well as exhaust ports 104 are opened for respective communication therethrough. As the exhaust ports or passages 104 are opened, the hot exhaust gases in the combustion chamber 50 flow from the combustion chamber 50 and into the afterburner chamber 134 via exhaust passages or orifices 104. However, at approximately the same time, or even slightly delayed from the opening of ports 104, the inlet ports 66, 68 and 70 are opened. It should be remembered that the fuel air mixture within the charge or crank chamber 32 was pressurized by compression thereof during the downward movement of piston 36. Consequently, when inlet ports 66, 88 and 70 are opened, the fuel-air mixture in chamber 32 flows at a high speed through passages 60, 62 and 64 into the combustion chamber 50 thereby helping to scavenge the exhaust gases out of the combustion chamber 50 and into the afterburner chamber 134.

When the piston 36 reaches its bottom dead-center, the previously described cycle repeats itself.

SECOND EMBODIMENT OF THE INVENTION

FIGS. 7 through 12 illustrate a second embodiment of the invention which, in many respects is either identical or similar to the engine as disclosed in FIGS. 1–6. All elements of FIGS. 7–12 which are like or similar to those of FIGS. 1–6 are identified with like reference numerals provided with a suffix *a*. Certain of the details or elements previously shown in FIGS. 1–6 are omitted for clarity.

Referring now in greater detail to FIGS. 7–12, the engine 10*a* is illustrated as comprising an upper engine housing section 14*a* which includes, as an integral portion thereof, a downwardly depending portion 140 which, in turn, carries an annular end member 142 with an orifice 144 formed therethrough and an annular valve seating surface 146 formed thereabout.

A shroud-like member 148 is situated generally within afterburner chamber 134*a* in a manner whereby its lower end is peripherally retained cooperatively by depending portion 140 and annular member 142, while its upper end is confined about a guide bushing - like member 150 retained in the upper wall 152 which separates the afterburner chamber 134*a* from the plenum chamber 86*a*. The shroud 148 is provided with a plurality of apertures or ports 154 for completing communication between afterburner chamber 134*a* and the interior of the shroud 148. A spring loaded valving member 156 comprised of a stem portion 158, slidingly guidingly received through the bushing 150, and a valve portion 160 which, at times, coacts with seat 146 to terminate communication therethrough. The spring loading may be accomplished as by a coiled compression spring 162 situated against the upper end of valve stem 158. Preferably, an axially extending passageway 164 is formed in the valve stem upwardly from the valve head 160 as to terminate in a radiating or transverse passageway 166.

In addition to the plurality of conduit communicating as between chambers 32*a* and 50*a*, as singly typically depicted by conduit means 60*a*, housing section 16*a* is provided with passage means 168 in communication with passage means 170, formed in the engine header section 14*a*, to define a coolant passageway or network if such be desired.

Figure 10:
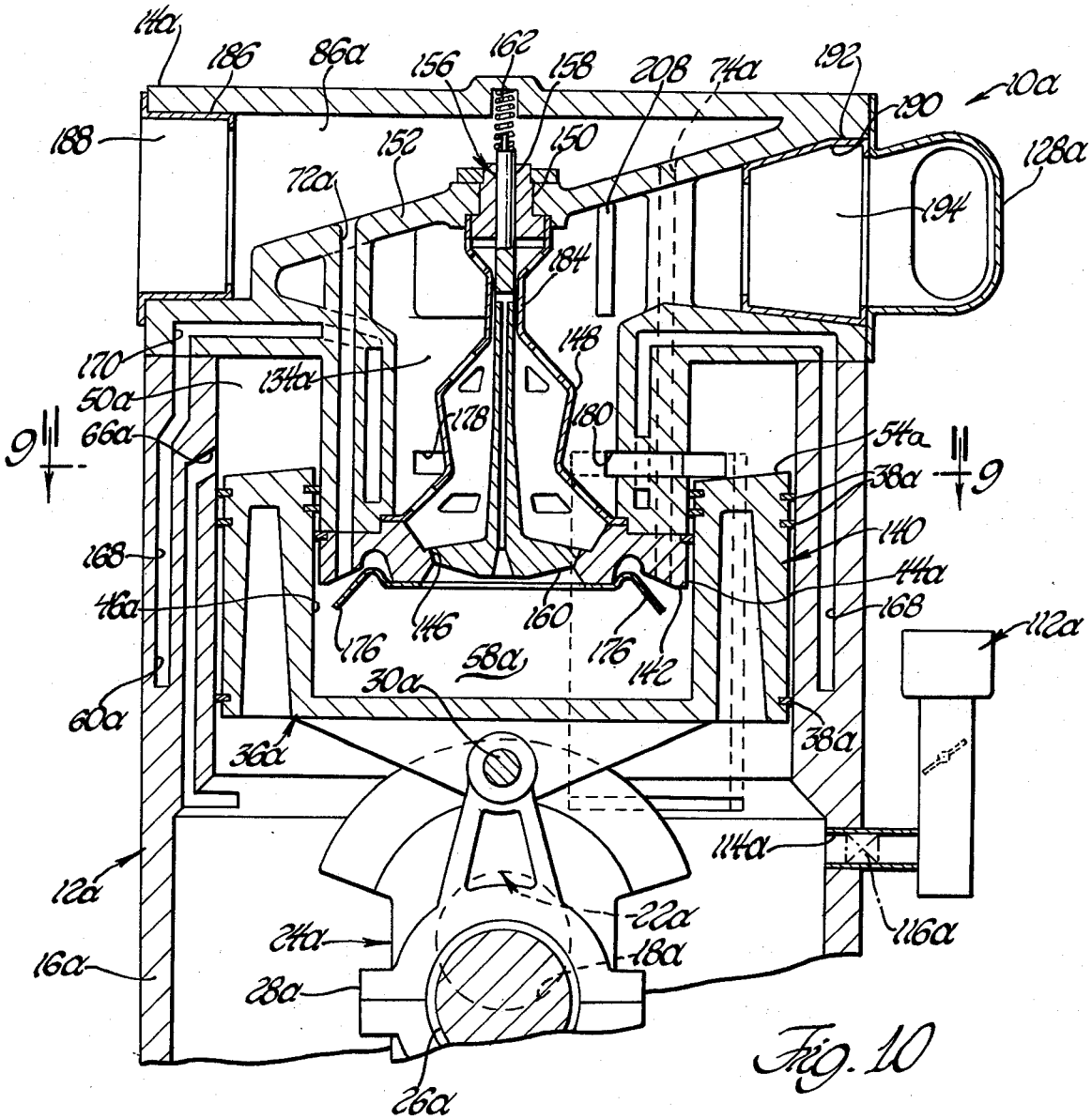
FIG. 10 is a fragmentary cross-sectional view similar to that of FIG. 7 but illustrating the piston in the bottom dead center of its stroke.

The plurality of passages, as typically depicted at 72*a* and 74*a* serve to communicate between upper chamber 86*a* and piston pumping chamber 58*a*. However, such communication is effectively for single directional flow from chamber 86*a* to pumping chamber 58*a* because of an annular reed-like check valve 174 suitably fixedly retained as at the end of member 142 whereby radiating portions 176 normally tend to spring slightly away from the lower openings of such passages as typically depicted at 72*a* and 74*a* and as best shown in FIG. 10. Further, as ring piston 36*a* moves upwardly not only is valving member 156 opened as previously described with reference to FIGS. 1–6, but the increased pressure within the decreasing volume of piston pumping chamber 58*a* is applied against such reed-like valving or check valve extensions 176 to hold them sealingly closed against the juxtaposed lower orifices of the passages leading upwardly to chamber 86*a*.

The annular shroud or shield 148 serves to initially receive the relatively cold fresh air from pumping chamber 58*a* and distribute such fresh air to the hot exhaust gases which are directed generally tangentially radially inwardly into the afterburner chamber 134*a* as by exhaust ports 178, 180 and 182. The relatively cold air being first received within the shield 148 helps keep the shield cool even though relatively hot exhaust gases are being admitted to the afterburner chamber. Additional cooling is also provided for the valving member as by passages 164 and 166. That is, upon opening of the valve portion 160, transverse passage 166 is taken out of registry with the necked-down portion 184 of shield 148 thereby permitting such cold air to pass through passages 164 and 166. Such cooling flow of air is terminated when valve 160 again becomes seated because at that time transverse passage 166 will again be received within necked-down portion 184 and closed thereby.

The inlet to plenum chamber 86*a* preferably contains an insert-like member 186 which may also include suitable filter material 188 for cleaning the incoming fresh ambient air, while the outlet 190 of chamber 134*a* is preferable provided with, for example, a catalytic converter sub-assembly 192 containing catalytic material 194 for further purifying the exhausting gases flowing to the exhaust conduit 128a.

Figure 8:
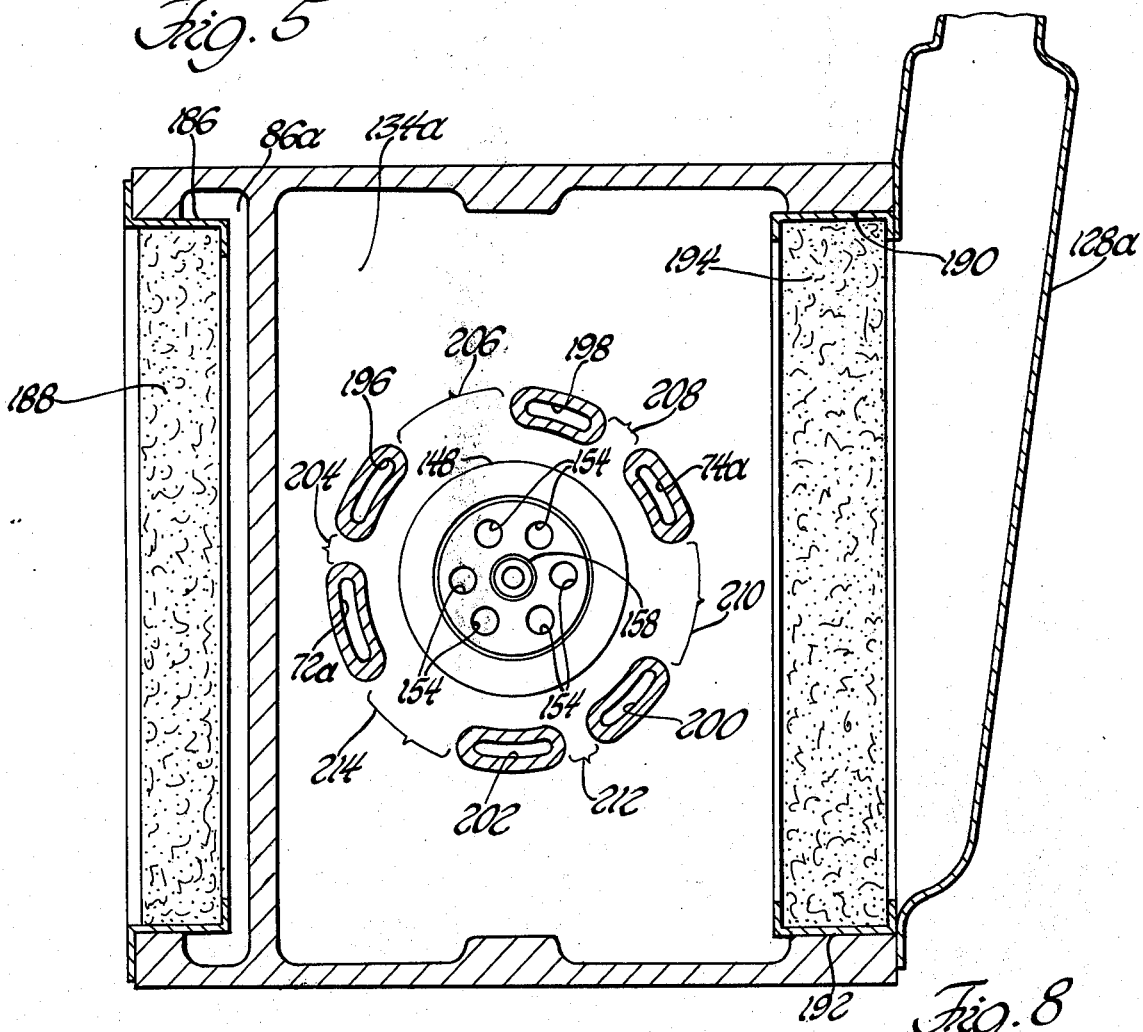
FIGS. 8 and 9 are each transverse cross-sectional views respectively taken on the planes of lines 8—8 and 9—9 of FIGS. 7 and 10, respectively, and looking in the direction of the arrows.

As previously generally indicated but as best shown in FIG. 8, in addition to passages 72*a* and 74*a*, passages 196, 198, 200 and 202 are also provided in a generally circular pattern and generally radially extending spaces, apertures or clearances 204, 206,208, 210, 212 and 214 are formed therebetween as to thereby complete communication between afterburner chamber 134*a* and exhaust outlet 190.

The operation of the engine, as disclosed in FIGS. 7, 8, 9 and 10 is as that described with reference to FIGS. 1–6 except, of course, for such features as have been specifically referred to as being somewhat a departure from that of FIGS. 1–6.

Figure 9:
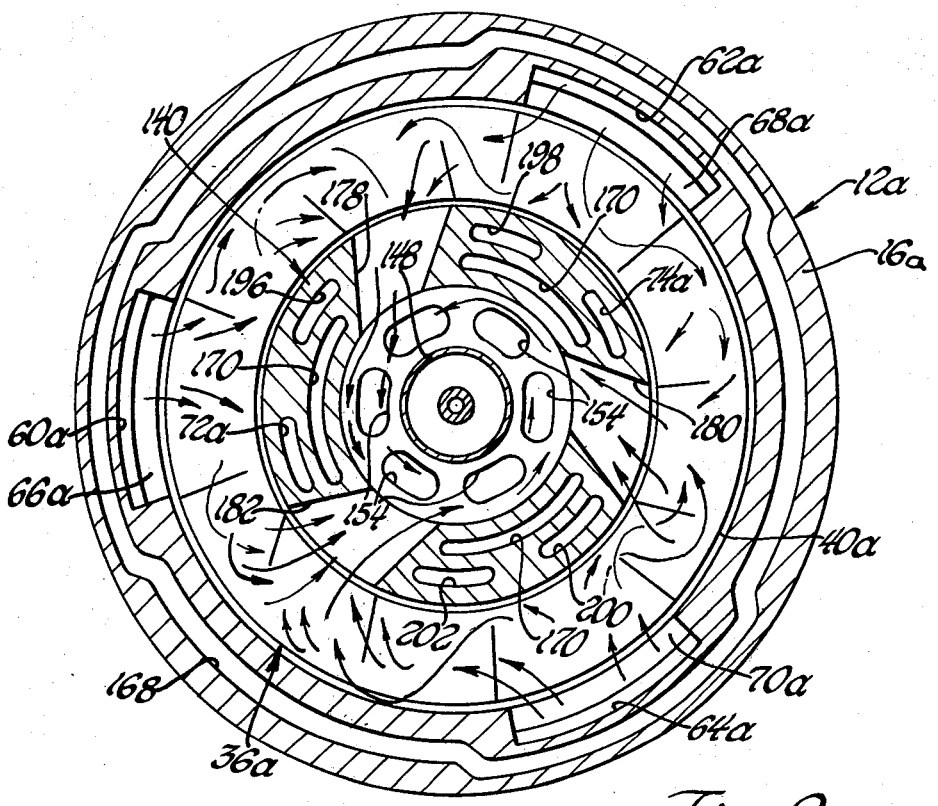

FIG. 9 illustrates, generally, the top of the piston 36 contained within the lower housing section 16 which is illustrated in cross-section. The exhaust ports of passages 178, 180 and 182 are shown as being somewhat angularly, rather than directly radially, positioned and aimed so that the exhaust gases coming from the combustion chamber are delivered into the afterburner chamber in a generally vortice-like distribution. To enhance this quality ports 178, 180 and 182 are wider at point of exhaust gas entry and relatively narrower at point of exhaust gas discharge into the afterburner chamber. The various undulating-like arrows diagrammatically depict the flow of both exhaust gases and the fresh relatively cold air being pumped upwardly through passages 60*a*, 62*a* and 64*a*.

Figure 11:
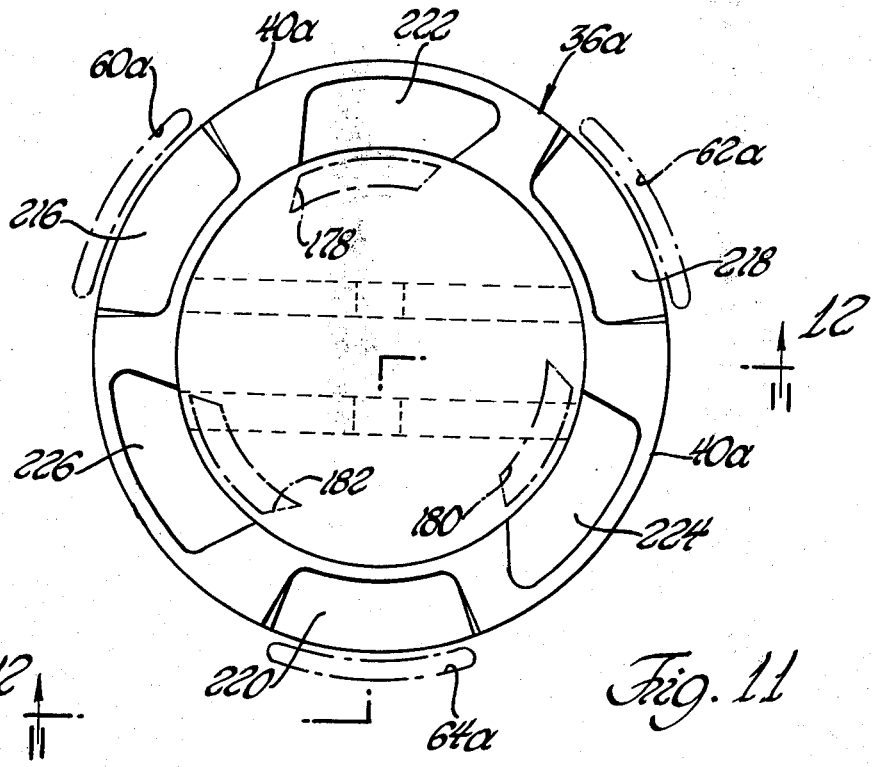
FIG. 11 is a top plan view of a ring type piston employable within the engine of the invention.
Figure 12:
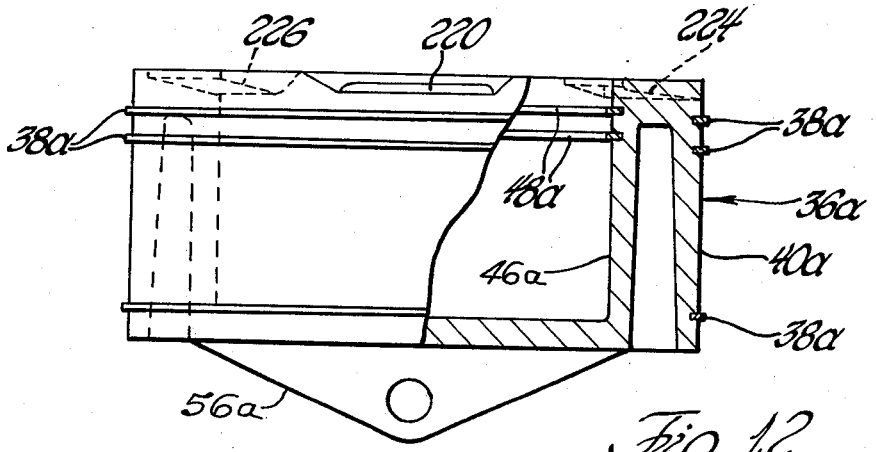
FIG. 12 is a view taken generally on the plane of line 12—12 of FIG. 11 and looking in the direction of the arrows.

FIGS. 11 and 12 illustrate in greater detail the preferred configuration of piston 36*a*. As shown, the top or head of piston 36*a* is formed to have a first plurality of inclined surfaces 216, 218 and 220 angularly spaced from each other and inclined so that the radially innermost edge thereof is at the higher elevation. A second plurality of inclined surfaces 222, 224 and 226 also angularly spaced from each other and generally interspersed between successive ones of the first plurality of surfaces. The second plurality of surfaces are so inclined as to have their radially innermost edges at the lower elevation. By providing such inclined surfaces the flow of relatively cold air into the combustion chamber from conduits 60*a*, 62*a* and 64*a* undergoes additional turbulence thereby aiding in the scavenging of exhaust gases from the combustion chamber 50*a*.

Figure 13:
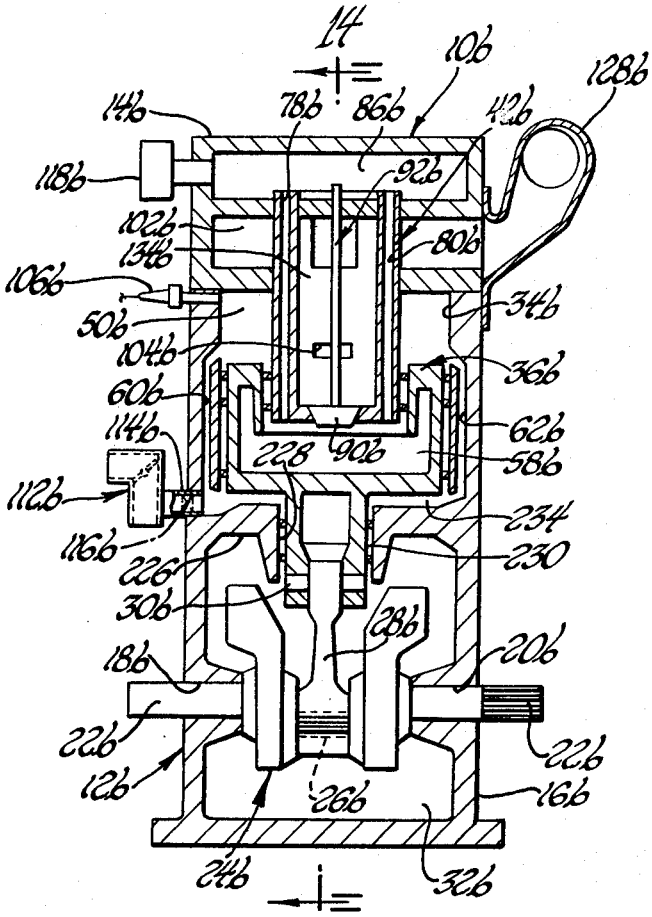
FIG. 13 is a view similar to that of FIG. 1 but illustrating a modification thereof.
Figure 14:
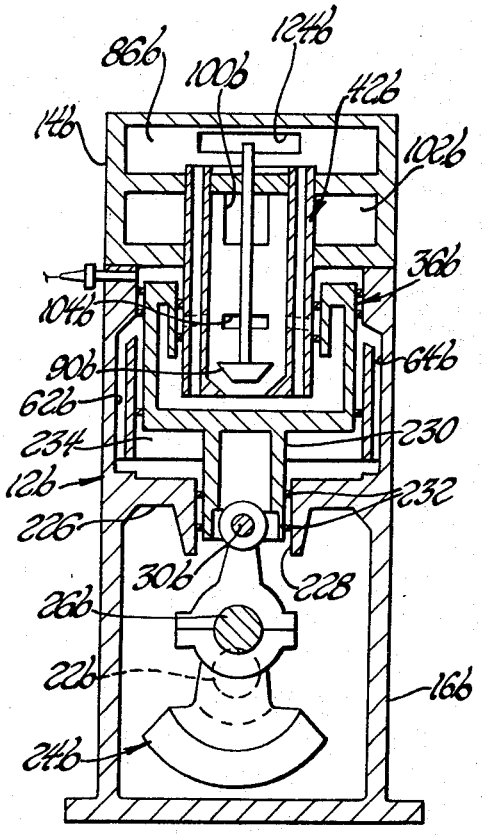
FIG. 14 is a view taken generally on the plane of line 14—14 of FIG. 13 and looking in the direction of the arrows.

FIGS. 13 and 14 illustrate another modification of the invention. All elements in FIGS. 13 and 14 which are like or similar to those of FIG. 1–6 are identified with like reference numerals provided with a suffix *b*.

The main difference between the structure of FIGS. 1–6 and that of FIGS. 13 and 14 is that in the latter the crank chamber 32*b* is effectively sealed from the bottom of piston 36*b* as by a transverse wall 226 which has an aperture 228 formed therein for the slidable reception of a cylindrical extension 230, including piston-like sealing rings 232, to which the crank 26*b* is pivotally secured as through wrist pin 30*b*. Consequently, a smaller total chamber 234 is formed between the bottom of piston 36*b* and the top of wall 226. Therefore, since the total volume of chamber 234 is significantly less than the total volume of crank chamber 32*a* of FIG. 1, and since the downward displacement of piston 36*b* is still the same, the ultimate compression and pressure rise experienced by the combustible fuel-air mixture in chamber 234 thereby assuring a higher injection pressure of such fuel-air mixture in to the combustion chamber 50*b* in the manner previously described with reference to FIGS. 1–6.

Figure 15:
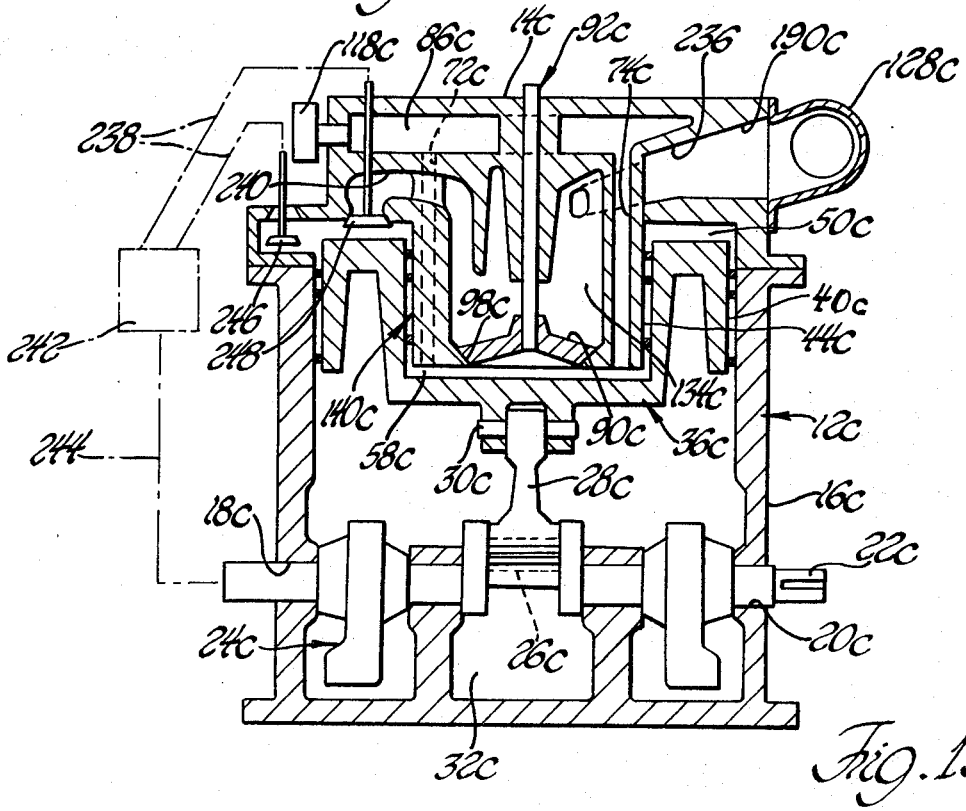
FIG. 15 is a view generally similar to that of FIG. 1 but illustrating a further embodiment of the invention.

FIG. 15 illustrates one embodiment of an engine embodying the teachings of the invention as applied to the conjunctive use of timed actuated valves. In the embodiment of FIG. 15 all elements which are like or similar to the elements of any of the preceeding figures are identified with a like reference numeral provided with a suffix *c*.

An inspection of FIG. 15 will show that an exhaust passage 236 communicates at one end with the afterburner or thermal reactor chamber 134*c* while its other end 190*c* is in communication with exhaust conduit 128*c*. Valve 90*c* is opened and closed in the manner previously described with reference to valve 90 to at times thereby complete communication between chambers 134*c* and 58*c*. A plurality of timed actuatable valves 246 and 248 are also provided and operatively connected as by motion transmitting means 238 to associated timing means 242 which, in turn, may be operatively connected to suitable means 244 effective for indicating crank angle postion.

As piston 36*c* moves downwardly valves 90*c* and 248 are closed while valve 246 is opened to permit the admission of motive fluid into expanding combustion chamber 50c. As piston 36c starts its upward movement, valve 90c is opened while valves 246 and 248 are closed. As the piston 36c approaches its top dead-center position valve 248 is opened for a brief time permitting some flow to occur from chamber 50c through conduit means 240 and into the afterburner or reactor chamber 134c. The actual respective timing of the opening and closing of valves 90c and 248 will be to some degree influenced by the engine speed and pressure differentials involved.

General Comments Relating to and Benefits of the Invention

From the preceeding it can be seen that each embodiment employs a particular ring piston which also has the basic form of a cup. Further, such cup-like ring piston is so formed as to enable power to be transmitted from it through a single piston rod and single crank. The advantage, obviously, is one of simplicity for easy manufacture and low cost. This type of construction also permits the continued use of most of the manufacturing tools and machines. Performance-wise, a new technical advance can be utilized by the new improved practical adaptation of a ring piston which is derived from theoretical findings. The inherent advantages become apparent when fully understood and applied according to the teachings of the invention. In the following detailed comments, it will be explained how, due to particular characteristics of a ring cylinder, there can be two important and outstanding advantages usefully explicted which are technically not feasible when a conventional cylinderical piston is employed. The first important advantage if that with a ring piston significant reductions in heat loss through the cylinder wall can be achieved. Secondly, with a ring piston of the particular novel construction according to the invention, it becomes a possibility that within the inner core of the ring piston another core of suitable dimensions can be created which in essence will function as an advanced and significantly improved afterburner whose performance will at least greatly reduce the exhaust emissions and quite possibly meet the strict governmental emissions standards. Thirdly, with new and improved configuration of a cup-like piston according to the invention additional benefits are made possible, of which the main advantage is the ability to select the correct size of the cup within the ring piston and thereby make it possible to establish, deliver and inject the most useful quantities of fresh ambient air into the afterburner section. Even excess air can be provided which at times and under certain conditions is desirable. And with predetermined pressure such air may be transferred automatically and regularly with each up-stroke of the cup-like ring piston. The advantage is that this pumping cycle will keep constant pace with the engine regardless of cranking speeds. This is an excellent contributing factor for better performance, mainly of the afterburner section.

The following are, in the main highlights of how a ring piston can be useful in minimizing heat losses through the cylinder wall as compared to heat losses incurred by the conventional piston engine.

Generally, a significant factor in heat transfer, in average conventional piston engines is the amount of combustible gas volume contacting the cylinder walls during the process of combustion within the combustion chamber. The effective relationship between area of the combustion chamber and the volume of combustible gas enclosed within the cylinder walls is known as the "surface to volume to ratio" (S/V) of the combustion chamber. As the surface area of the combustion chamber increases, the gases are exposed to a greater cooling area. However, the quantity of heat added for a given load and a given air-fuel ratio (A/F) depends on the amount of fuel introduced into the combustion chamber. The heat produced for a given amount of air-fuel mixture is utilized as work within the combustion chamber. It is also well known that the space or volume of the combustion chamber in which such heat is generated and confined is very important because part of such generated heat will be lost through the combustion chamber walls; the amount of such heat loss, in turn, depends on the S/V ratio. That is, the larger the S/V ratio the greater the heat loss will be through the cylinder walls. Therefore, the expected cooling of the gases within a particular combustion chamber is directly related to its surface-to-volume ratio, S/V.

However, the top or crown surface area of the piston is not included in the computations or calculations of the S/V ratio because such surface does not provide a direct path for heat conduction from the combustion chamber to the engine coolant or water jacket. Accordingly, with this in mind, the S/V ratio can be manipulated to the best advantage of reducing potential heat losses in the following manner.

As will become apparent, the S/V ratio between a smaller diameter piston and a larger diameter piston can be considerably different. As an example, let two different engines be considered wherein both the piston-diameter-to-stroke ratios and compression ratios of the engines are equal to each other but the first engine has a 3.0 inch bore and 3.0 inch stroke (with a compression gap of 0.67 inch at top dead center).

With regard to the first example, that being the 3.0 inch bore, it can be seen that the combustion chamber surface would be the area at the top of the cylinder plus the cylindrical wall area at top dead center piston position, or $$\text{Surface} = \frac{\pi \cdot D^2}{4} + (2\pi \cdot r \times 0.67)$$

Where:

$\pi = 3.14$ $D = 3.0$ inches $r = 1.50$ inches therefore: Surface area = 13.38 square inches. However, the volume of that combustion chamber would be:

$$\text{Volume} = \frac{\pi \cdot D^2}{4} \times 0.67 = 4.74 \text{ cubic inches}$$

The ratio of the above would be:

$$S_1/V_1 = 13.38/4.74 = 2.82/1.00$$

With regard to the second example, that being the 6.0 inch bore, it can be seen that the combustion chamber surface area ($S_2$) would be the area at the top of the cylinder plus the cylindrical wall area at top dead center piston position, or, $$S_2 = \frac{\pi \cdot D^2}{4} + (2.\pi \cdot r \times 1.34)$$

Where $\pi = 3.14$ $D = 6.0$ inches $r = 3.0$ inches therefore: the Surface area, $S_2$, = 53.54 square inches. However, the volume ($V_2$) of that combustion chamber would be:

$$V_2 = \frac{\pi \cdot D^2}{4} \times 1.34 = 37.6 \text{ cubic inches}$$

The ratio of the above would be:

$$S_2/V_2 = 53.54/37.6 = 1.43/1.00$$

The above two examples illustrate a striking difference between the respective surface to volume ratios. That is, it can be seen that the smaller cylinder has an approximate 100% greater surface to volume ratio than the other cylinder which is 100% larger in diameter.

Even though the 6.0 inch cylinder has a comparatively favorable surface to volume ratio, it nevertheless, can not as a practical matter be employed in automotive applications primarily because of the 6.0 inch stroke (or one close to it) which would have to be employed as a practical matter giving due consideration to feasible compression ratios.

In view of the above, the advantages of the ring-type piston and cylinder of the invention can now better be considered. Generally, the following will show that the ring piston and cylinder of the invention will provde a better surface to volume ratio while at the same time reducing the piston stroke from what would otherwise be required by the prior art.

In order to illustrate the above and better relate it to the first example of a 3.0 inch cylinder and piston, let the following be assumed:

| | | |
|---|---|---|
| (1) $D_1$ | = 15.00 inches = | the outer diameter of the ring piston of the invention: |
| (2) $D_2$ | = 12.00 inches = | the inner diameter of the ring piston of the invention: |
| (3) C.G. | = 0.67 inches = | compression gap at top dead center of piston stroke; |
| (4) $r_1$ | = ½ × $D_1$ = 7.50 inches | |
| (5) $r_2$ | = ½ × $D_2$ = 6.00 inches | |
| (6) stroke | = 3.00 inches (same as in previous first example) | |

Therefore, the surface area ($S_3$) of the ring cylinder can be computed as follows: $S_3 = 69.92$ square inches $$S_3 = \frac{(\pi \cdot D_1^2)}{4} - \frac{(\pi \cdot D_2^2)}{4} + [\,(2\pi r_1 - 2\pi r_2) \times (0.67)\,]$$

The volume of the combustion chamber can be calculated as follows:

$$V_3 = \frac{(\pi \cdot D_1^2)}{4} \quad \frac{(\pi \cdot D_2^2)}{4} \times (0.67) = 42.6 \text{ cubic inches}$$

Accordingly, in view of the above it can be seen that the surface to volume ratio of the ring cylinder of the invention is:

$$S_3/V_3 = 69.92/42.06 = 1.63/1.00$$

In comparing the value of $S_3/V_3$ to the value of $S_1/V_1$ it can be seen that the volume content was increased to 69.92 square inches while the surface area was reduced to 42.6 cubic inches and that there has been a 42% reduction in the surface to volume ratio.

According to the prior art, if one wanted to change the surface to volume (S/V) ratio substantially it was necessary to increase the piston diameter simultaneously with the piston stroke. As in the case of the second example considered (the 6.0 bore and 6.0 stroke engine) the S/V ratio was improved by about 100% by increasing the cylinder volume eight times and doubling the stroke.

Now, let it be assumed that a first engine having a 3.0 inch bore and 3.0 stroke has a total of four cylinders which, as a conventional engine, would have two explosions or ignitions occurring per revolution, and that such an engine were to be replaced by an engine of a single cylinder, of prior art design, having a volume equal to eight small cylinders of the first engine. Let these two engines be compared on an assumed operational speed of 6,000 R.P.M. of the smaller engine.

Accordingly, in order for the single large conventional piston engine to have an explosion volume equal to that produced by the four cylinder engine, would have to run slower. This is, being of four-cycle, the one large cylinder would have one working or power stroke for each two revolutions. For example, the small four cylinder engine with two explosions per revolution would have, at 6,000 R.P.M., a working volume of: 12,000 × 4.75 cubic inch = 57,000 cubic inches whereas, the single large piston having a volume eight times larger would have to undergo or attain an R.P.M. or only 3,000 R.P.M. in order to produce an equivalent working volume of 57,000 cubic inches with all such volumetric computations being based on S/V ratios.

Obviously, even though certain advantages are obtained with such a theoretical single large piston engine, it does not result in a desirable engine design especially when one considers that it would have one working stroke every second engine revolution.

However, with the ring type cylinder and piston of the invention, highly desirable characteristics are obtained. The following tabulated data (obtained from previous calculations) illustrates the comparison between the single 3.0 inch bore, 3.0 inch stroke cylinder of the first example to the single ring cylinder of the invention.

| | Single 3.00 in Cyl. | Single Ring Type Cyl. |
|---|---|---|
| Volume | 4.75 cu. in. | 42.6 cu. in. |
| Volume Incrase | — | 9 times |
| S/V ratio | 2.82/1.00 | 1.63/1.00 |
| Stroke | 3.00 inches | 3.00 inches |
| Compression | Same | Same |

Since the single ring type cylinder, of the third example previously given, has a total volume of 42.6 cubic inches, which is approximately nine times the volume of one single 3.00 inch cylinder of the small four cylinder engine, it should be obvious that the ring cylinder engine, in producing the same explosive volume, would run proportionately slower. In addition, as shown by the preferred embodiments of the invention herein disclosed and described, it is preferable that the ring piston be employed as a two-cycle engine instead of a four-cycle engine.

Accordingly, in order for the single ring piston to produce a comparable power output, 57,000 cubic inches of combustible mixture has to be exploded in the ring cylinder every minute. However, if the ring piston is in a two-cycle engine, each down stroke of the ring piston will be power stroke. Therefore, in order to determine the engine R.P.M. of the ring piston engine the total of 57,000 cubic inches per minute has to be divided by 42.6 cubic inches per stroke (which is also per R.P.M.) which results in 1,350.0 R.P.M. required for the single ring piston engine to produce the equivalent power.

In view of the above, it can be seen that the ring piston engine of the invention will produce the same power as the smaller diameter (3.0 inch) bore, four cylinder engine but at a much slower engine speed. That is, the same power as was produced by the four cylinder engine at 6,000 R.P.M. is produced by the ring piston engine at 1,350.0 R.P.M.

As a consequence of the above, additional benefits relating to piston speed, are derived. In the conventional four cylinder engine referred to, at an engine speed of 6,000 R.P.M., each piston has to travel twice the stroke for each engine revolution. Therefore, in such a prior art engine as assumed herein, the average piston speed would have to be 3,000.0 feet/minute while the average piston speed for the comparable ring piston of the invention, also traveling for each engine revolution twice the stroke, would only be 675.0 feet/-minute. In other words, the comparable ring piston engine reduces piston speed by approximately 75%, reduces the surface to volume ratio (S/V) by over approximately 42% and yet produces the same power output.

Figure 7:
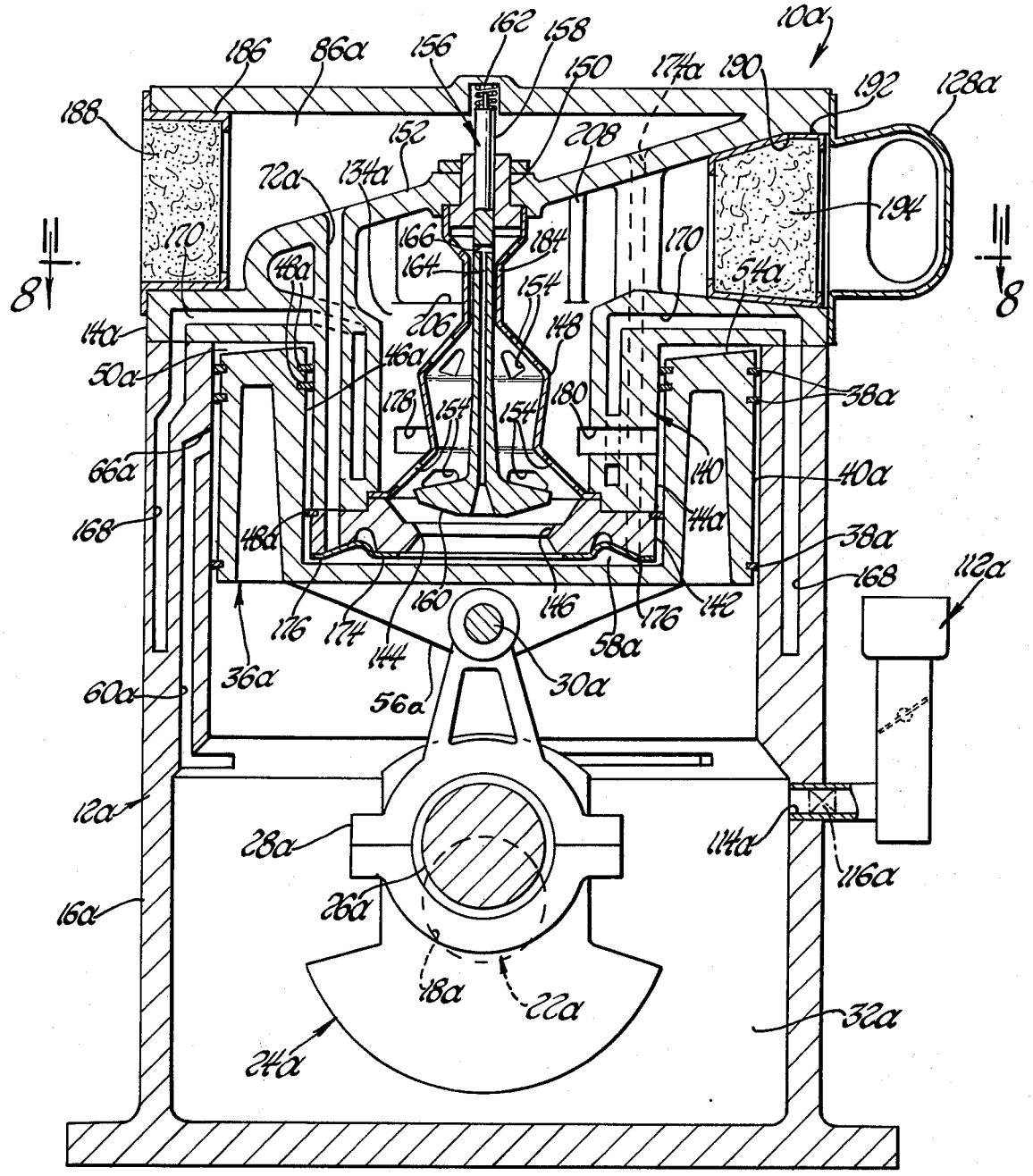
FIG. 7 is a view similar to FIG. 1 but illustrating in enlarged scale and in greater detail the possible combination and relationship of elements comprising the entire engine assembly.

Accordingly, in view of the above, it can be seen that the invention as herein disclosed provides a ring piston engine, whether of the single or double ring piston variety, which has a significantly improved surface to volume ratio and reduced piston speed which, especially when combined with an afterburner section or chamber, such as for example chamber 134 of FIG. 1, chamber 134*a* of FIG. 7 or chamber 134*b* of FIG. 13 for the continued burning of the exhaust gases, has performance characteristics unlike that of the prior art engines and is also effective for either totally or at least greatly inherently minimizing the production of air-polluting exhaust emissions.

Further, through the novel incorporation of an afterburner which is situated mainly in the inner core of the inner wall of a ring cylinder housing, which in turn is fitted with a cup-like ring piston, significantly improved efficiency of the afterburner can be achieved because the cup-like addition to the afterburner can be achieved because the cup-like addition to the ring piston is a significant contributing factor for an increased efficiency of said afterburner.

The basic thermal reactor features when used with a conventional engine are essentially a unit added to the outside of such an engine. Such are add-on devices with a heavy cast iron body having an insulated reactor chamber in which unburned HC and CO emitted from the combustion chamber are oxidized into $CO_2$ and $H_2O$ in the presence of air at high temperatures. Oxidation is achieved by addition of secondary air to the exhaust gases entering the reactor. A heavy walled cast iron outer housing is necessary to provide adequate strength to support the pressures and also support the sheet metal liner and the attached exhaust system. The sheet metal liner of various shapes essentially serve the purpose of preventing the hot exhaust gases from scrubbing and quenching against the cooler cast iron surfaces in certain regions. This is particularly important during engine warm-up. For better efficiency high temperature applications, blanket type insulation is used in the better quality reactors. Such insulation is located between the outer housing and the sheet metal internal liners to retain the reactor heat. Such composite materials, as described above, do improve the overall efficiency of the reactor system. The period during which a rapid oxidation of HC and CO occurs due to elevated exhaust temperatures is called residence time.

It is obvious that any such specific add-on thermal reactor, no matter how efficient it is, will have a given weight of its own, will consume or require a specific volume of space beside the engine, and very probably require the use of a heat shield as between itself and the vehicle. Further, such a thermal reactor has its own price and installation costs which must be paid. Obviously, if any one or more of the above penalties could be eliminated, it would be considered technological and economical progress.

It should be quite apparent that with the invention as herein disclosed that indeed a substantial improvement in all of the above-mentioned prior art deficiencies is achieved.

The invention makes it clear that the thermal reactor, as in the form of an afterburner, can be incorporated into the center core of the engine itself thereby making it unnecessary to provide separate add-on thermal reactor units. This, in turn, means that the housing required space and at least a substantial portion of the weight of the add-on thermal reactor has been eliminated. It should also be pointed out that while the external add-on type thermal reactor needs its own housing of heavy cast iron it still must be connected to a special heaving manifold structure. This is not required by the invention.

In contrast, the engine of the invention does not require a manifold at all and does not require an extra independent housing for its thermal reactor section because the inner ring cylinder walls do provide, simultaneously, the housing for the centrally located aferburner or thermal reactor thereby making the conventional exhaust manifold obsolete because the transition of the exhaust gases from the combustion chamber is in a most direct path as through porting through the inner cylinder wall of the ring cylinder. Therefore, the flow of the gases from one compartment to another is at least 90% shorter and heat losses via manifold and reactor surfaces is totally eliminated.

Further, there are quite a number of performance benefits to be gained from the utilization of a cup-like ring cylinder and a centrally located afterburner operating in unison and specifically in the mode of a two-cycle engine.

It is well known that ordinarily a two-cycle engine is generally considered inferior to a four-cycle engine by comparison. The decisive factor for this general belief, thus far, was that the two-cycle engine had the obvious disadvantage of consuming more fuel (about 23% average) than a four-cycle engine of the same rated horsepower.

However, since the inception of stringent exhaust emission standards the advantage of the four-cycle engine over the two-cycle engine in regard to better fuel economy does not exist anymore. In fact, it has been proven that the four-cycle engines must operate on richer fuel mixtures so that the after treatment of the exhaust gases can be efficient. However, all of this is done with the result being that the combustion chamber delivers less working energy because of reduced compression ratio which is made necessary in order to reduce oxides of nitrogen ($NO_x$) emissions. Therefore, the use of richer fuel-air mixtures does not in any way improve the power output of the engine.

Accordingly, if an engine of the four-cycle type were to maintain the same output horsepower as it could have if operating before the imposition of emission standards, it would consume about 23% to 25% more fuel.

In view of the penalties, it becomes obvious that the fuel economy of a four-cycle engine, of the present state of the art, versus a two-cycle engine is now substantially the same and the contention that a four-cycle engine has better fuel economy, as compared to a two-cycle engine of the same rated output, is not true anymore. To better understand how the prior art emission controls effect the engine technology, the following table is presented wherein the emissions of a four-cycle and two-cycle engine (of the same rating) are compared with such comparison being made on engine operation without any added emission control devices.

AVERAGE EMISSIONS WHEN OPERATED AT FULL LOAD WITH OPTIMUM FUEL/AIR RATIO

| Four-Cycle Engine | Two-Cycle Engine |
|---|---|
| 8.0g. of HC/H.P.-h | 140.0g. of HC/H.P. -h |
| 180.0g of CO/H.P.-h | 250.0g. of CO/H.P. -h |
| 5.0g. of $NO_x$/H.P.-h | 1.7g. of $NO_x$/H.P.-h |

From the above, it should be apparent that the $NO_x$ emission level, which is the most difficult emission to reduce or eliminate in a four-cycle engine, is already 66% lower in the two-cycle engine.

When a thermal reactor is combined with an engine, the reactor needs about 20 to 25% unburned HC residue in the engine exhaust for efficient operation. For this reason, when a thermal reactor is operated in connection with a four-cycle engine it becomes necessary to re-calibrate the fuel mixture to be richer by about 15 to 20% so that the exhaust gases while flowing from the combustion chamber to the reactor are still carrying the required amount of unburned HC into the reactor for further oxidation. As far as power output is concerned, the additional fuel thereby provided to the engine is a total waste.

Therefore, when both the four-cycle engine and two-cycle engine have to operate in conjunction with an afterburner or thermal reactor, the prior existing poorer fuel economy of the two-cycle engine is nullified because the two-cycle engine, in conjunction with a thermal reactor, has enough unburned HC in the exhaust gases to sustain the oxidation process within the reactor. Therefore, the two-cycle engine would not need an increased richness in its fuel-air ratio. In fact, and in accordance with the invention, the fuel economy of the two-cycle engine is substantially improved because of the reduction in heat losses gained through the improved S/V ratio from the ring piston. Further, the described reduction of the piston speed also reduces the frictional losses as well as reduces the inherent noise level of the engine.

Further, the efficiency of the thermal reactor of the invention is a substantial improvement over the prior art in that excess quantities of fresh air can be effectively injected into the thermal reactor as by the pumping action of the cup-shaped ring piston.

In the invention, the further reduction of $NO_x$ emissions is mainly achieved as by a catalyst cartridge-like insert, in the exhaust system of the engine, which is easily replaceable if it cannot last for the life of the engine. Such a catalyst cartridge may be comprised of a ceramic type, platinum lined, or pellet-type device and it might be best to provide an individual cartridge for each cylinder of a multi-piston engine.

It should also be evident that the invention does not waste fuel which is otherwise wasted by prior art engines in the form of blow-down losses. In the invention, even if blow-down occurs, such fuel is subsequently pumped into either or both the afterburner chamber and the combustion chamber as previously described.

Although only selected preferred embodiments and modifications of the invention have been disclosed and described, it is apparent that other embodiments and modifications of the invention are possible within the scope of the appended claims.

I claim:

1. An internal combustion engine, comprising engine housing means, an annular cylinder formed in said housing means, said annular cylinder comprising a first radially inner annular wall and a second radially outer annular wall, combustion chamber means communicating with said annular cylinder, cup-like ring piston means received in said annular cylinder for reciprocating movement therein, motion transmitting means operatively connected to said ring piston means for transmitting the reciprocating movement of said ring piston means to associated power output means, afterburner means situated generally radially inwardly of said first inner annular wall and in communication with the ambient atmosphere, and exhaust passage means communicating between said combustion chamber means and said radially inwardly situated afterburner means, said afterburner means being effective to receive said exhaust gases from said exhaust passage means to enable further continued combustion of said exhaust gases within said afterburner means before discharging said exhaust gases to said ambient atmosphere.

2. An internal combustion engine according to claim 1, wherein said exhaust passage means is formed through said first inner annular wall.

3. An internal combustion engine according to claim 1, wherein said cup-like ring piston means comprises first and second annular walls, wherein said first annular wall is juxtaposed to said first radially inner annular wall, wherein said second annular wall is juxtaposed to said second radially outer wall, said cup-like ring piston means further comprising an end wall situated generally transverse to said first and second annular walls and connected to one of said first and second annular walls as to effectively close said one of said first and second annular walls.

4. An internal combustion engine according to claim 1, wherein said cup-like ring piston means comprises first and second annular piston walls, wherein said first annular piston wall is juxtaposed to said first radially inner annular wall, wherein said second annular piston wall is juxtaposed to said second radially outer annular wall, said cup-like ring piston means further comprising an end wall situated generally transverse to said first and second annular piston walls and joined to said first annular piston wall.

5. An internal combustion engine according to claim 1, wherein said motion transmitting means comprises at least one rotary crankshaft situated at one axial side of said cup-like piston means and operatively connected thereto.

6. An internal combustion engine according to claim 1, wherein said afterburner means comprises an afterburner chamber with conduit means situated therein and communicating therewith, wherein said exhaust passage means is in communication with said afterburner chamber, and further comprising ambient air pumping means communicating with said conduit means situated within said afterburner chamber for supplying therethrough additional quantities of ambient air to said afterburner chamber in order to mix said ambient air with said exhaust gases in said afterburner chamber, and wherein said afterburner chamber is effective to employ the oxygen within said additional quantity of ambient air to further combust said exhaust gases before discharging said exhaust gases to said ambient atmosphere.

7. An internal combustion engine according to claim 3, wherein said motion transmitting means comprises at least one rotary crankshaft situated at one axial side of said cup-like ring piston means, and at least one connecting rod operatively connected to said rotary crankshaft and to said end wall of said cup-like ring piston means.

8. An internal combustion engine according to claim 1, wherein said exhaust passage means comprises a plurality of exhaust ports formed in said housing means generally radially inwardly of said annular cylinder and in communication therewith, and further comprising a plurality of inlet passages formed in said housing means generally radially outwardly of said annular cylinder, said inlet passages being adapted for supplying combustion air to said annular cylinder, said cup-like ring piston means comprising a head surface area comprised of a plurality of angularly spaced first and second contoured surfaces alternately interspaced, said first contoured surfaces being so positioned as to be at times placed in general radial juxtaposition to said inlet passages, said second contoured surfaces being so positioned as to be at times placed in general radial juxtaposition to said exhaust ports, said first and second contoured surfaces having portions inclined generally oppositely to each other for enabling said combustion air entering said annular cylinder from said inlet passages to form swirl paths within said annular cylinder in order to thereby better scavenge the exhaust gases from said annular cylinder and into said exhaust ports.

9. An internal combustion engine according to claim 1, and further comprising ambient air pumping means effective for supplying additional quantities of ambient air to said afterburner means in order to mix said ambient air with said exhaust gases in said afterburner means, and wherein said afterburner means is effective to employ the oxygen within said additional quantity of ambient air to further combust said exhaust gases before discharging said exhaust gases to said ambient atmosphere.

10. An internal combustion engine according to claim 1, and further comprising a pumping chamber, said pumping chamber being formed generally on the axial side of said cup-like ring piston means opposite to said combustion chamber means being adapted for communication with ambient air, second passage means communicating generally between said pumping chamber and said combustion chamber means, said cup-like ring piston means being effective when moving in a first direction toward said combustion chamber means to increase the effective volume of said pumping chamber to thereby cause said ambient air to flow into and fill said pumping chamber, said cup-like ring piston means being effective when moving in a second direction opposite to said first direction for decreasing the effective volume of said pumping chamber to thereby force said ambient air from said pumping chamber through said second passage means and into said combustion chamber.

11. An internal combustion engine according to claim 10 and further comprising means for supplying combustible fuel to said combustion chamber means.

12. An internal combustion engine according to claim 1 wherein said afterburner means comprises an afterburner housing means, and wherein said first radially inner annular wall of said annular cylinder comprises a portion of said afterburner housing means.

13. An internal combustion engine according to claim 1 wherein said afterburner means comprises afterburner housing means, wherein said first radially inner annular wall of said annular cylinder comprises a portion of said afterburner housing means, wherein a portion of said afterburner housing means is continuously received with said cup-like ring piston means to thereby define a pumping chamber of distinct but variable volume generally within said cup-like ring piston means, said afterburner means comprising afterburner chamber means formed generally within said afterburner housing means and adapted for communication with said ambient atmosphere to thereby exhaust to said ambient atmosphere, valving means effective for at times terminating communication as between said afterburner chamber means and said pumping chamber, and air supply passage means for communicating between a source of ambient atmosphere and said pumping chamber.

14. An internal combustion engine according to claim 13, wherein said air supply passage means is formed through said afterburner housing means.

15. An internal combustion engine according to claim 13 wherein said valving means is closed to thereby terminate said communication as between said afterburner chamber means and said pumping chamber as said cup-like ring piston means is moving in said annular cylinder in a first direction away from said combustion chamber means, and wherein said valving means is opened upon said cup-like ring piston means moving in said annular cylinder in a second direction opposite to said first direction.

16. An internal combustion engine according to claim 13 and further comprising resilient resistance means operatively resiliently urging said valving means closed.

17. An internal combustion engine according to claim 13 and further comprising second valving means for controlling communication as between said air supply passage means and said pumping chamber, said second valving means being closed to thereby preclude flow through said air supply passage means when said cup-like piston means moves in said annular cylinder in a direction toward said combustion chamber means.

18. An internal combustion engine according to claim 13, wherein said source of ambient atmosphere comprises an air plenum chamber carried by said engine housing means, and wherein said plenum chamber is provided with inlet passage means communicating with said ambient atmosphere.

19. An internal combustion engine according to claim 18 and further comprising check means cooperating with said inlet passage means for preventing flow out of said plenum chamber and into said ambient atmosphere.

20. An internal combustion engine according to claim 1 wherein said cup-like ring piston means by virtue of being received in said annular cylinder for reciprocating movement therein defines a pumping chamber of distinct but variable volume generally within said cup-like ring piston means, wherein said afterburner means comprises afterburner chamber means, and further comprising second passage means for at times completing communication as between said afterburner means and said pumping chamber, and third passage means effective for communicating between a source of ambient air and said pumping chamber.

21. An internal combustion engine according to claim 20 and further comprising valving means effective for at times terminating communication between said pumping chamber and said afterburner chamber means.

22. An internal combustion engine according to claim 20 and further comprising valving means effective for at times terminating communication between said pumping chamber and said source of ambient air through said third passage means.

23. An internal combustion engine according to claim 21 and further comprising second valving means effective for at times terminating communication between said pumping chamber and said source of ambient air through said third passage means.

24. An internal combustion engine according to claim 1 wherein said cup-like ring piston means by virtue of being received in said annular cylinder for reciprocating movement therein defines first pumping chamber means of distinct but variable volume generally within said cup-like ring piston means, wherein said afterburner means comprises afterburner chamber means, and further comprising second passage means for at times completing communication as between said afterburner chamber means and said first pumping chamber means, third passage means effective for communicating between a source of ambient air and said first pumping chamber means, second pumping chamber means, said second pumping chamber means being formed generally on the axial side of said cup-like ring piston means opposite to said combustion chamber means and being adapted for communication with ambient air, and fourth passage means communicating generally between said second pumping chamber means and said combustion chamber means, said cup-like ring piston means being effective when moving in a first direction toward said combustion chamber means to increase the effective volume of said second pumping chamber means to thereby cause said ambient air to flow into and fill said second pumping chamber means, said cup-like ring piston means also being effective when moving in said first direction to decrease the effective volume of said first pumping chamber means in order to thereby cause flow of ambient air from said first pumping chamber means to said afterburner chamber means, said cup-like ring piston means being further effective when moving in a second direction opposite to said first direction for decreasing the effective volume of said second pumping chamber means to thereby force said at least some of said ambient air from said second pumping chamber means through said fourth passage means and into said combustion chamber means, and said cup-like ring piston means further being effective when moving in said second direction to increase the effective volume of said first pumping chamber means to thereby cause said ambient air to flow into said first pumping chamber means through said third passage means.

25. An internal combustion engine according to claim 10 and further comprising fuel supply means for supplying fuel to said ambient air flowing into said pumping chamber.

26. An internal combustion engine according to claim 1 wherein said cup-like ring piston means comprises a first radially outer generally tubular wall, a second radially inner generally tubular wall radially spaced from said first radially outer generally tubular wall, a lower end wall generally effectively transverse to said first and second generally tubular walls and joined to one of said first and second generally tubular walls, and an upper piston head wall, said piston head wall being generally annular and effectively joining said first and second generally tubular walls to each other.

27. An internal combustion engine according to claim 26 wherein one of said first and second tubular walls is axially shorter than the other of said first and second tubular walls.

28. An internal combustion engine according to claim 26 wherein said lower end wall is joined to said first radially outer generally tubular wall.

29. An internal combustion engine according to claim 21 and further comprising shielding means situated within said afterburner means for providing a degree of heat shielding for said valving means.

30. An internal combustion engine according to claim 29 wherein said shielding means comprises a generally tubular member generally surrounding said valving means so as to be generally between said valving means and said exhaust passage means.

31. An internal combustion engine according to claim 20 wherein said motion transmitting means comprises at least one rotary crankshaft situated generally on one axial side of said cup-like ring piston means, and further comprising housing wall means situated generally between said cup-like ring piston means and said rotary crankshaft as to define on one side thereof a crankshaft-containing chamber and to define on an other side thereof opposite to said one side an end surface of said pumping chamber, an axially medially extending extension carried by said cup-like ring piston means extending through cooperating aperture means formed in said housing wall means, and connecting means operatively connecting said extension to said crankshaft.

32. An internal combustion engine according to claim 31 wherein said extension is generally cylindrical in outer configuration, and wherein said connecting means comprises a connecting rod pivotally connected to said extension and journalled to said crankshaft.

33. An internal combustion engine according to claim 20 and further comprising first valving means effective for at times terminating communication as between said afterburner chamber means and said pumping chamber, second valving means cooperating with said exhaust passage means to open and close said exhaust passage means in timed relationship to engine operation, and third valving means cooperating with fourth passage means leading from said combustion chamber means to said ambient atmosphere, said third valving means being effective to open and close said fourth passage means in timed relationship to engine operation.

34. An internal combustion engine according to claim 1 and further comprising exhaust gas purifying means situated generally between said afterburner means and said ambient atmosphere so as to thereby cause said further combusted gases to pass through said purifying means as said further combusted gases flow from said afterburner means to said ambient atmosphere, said exhaust gas purifying means comprising a cartridge type assembly comprising a cartridge housing with aperture means formed therein to accommodate the flow of said further combusted gases therethrough, and exhaust gas reactant means carried generally within said cartridge housing through which said further combusted gases flow and with which said further combusted gases react.

35. An internal combustion engine according to claim 20 and further comprising valving means for at times terminating said communication between said pumping chamber and said afterburner chamber means through said second passage means, said valving means comprising a movable valve member, and coolant passage means formed through said valve member, said coolant passage means comprising inlet means disposed generally in the path of flow of said ambient air from said pumping chamber to said afterburner chamber means whereby a portion of said ambient air from said pumping chamber may flow through said coolant passage means to prevent said valve member from becoming damaged due to the heat of said exhaust gases entering said afterburner chamber means.

36. An internal combustion engine according to claim 1 wherein said engine housing assembly comprises at least first and second separable housing section means, said first radially inner annular wall being formed in said first housing section means, said second radially outer annular wall means being formed in said second housing section means, said first and second housing section means being effective when in assembled relationship to define said annular cylinder in a manner whereby said first and second inner and outer annular walls are in generally radial juxtaposition to each other.

* * * * *